US007243392B2

(12) United States Patent
Demirtas

(10) Patent No.: US 7,243,392 B2
(45) Date of Patent: Jul. 17, 2007

(54) DEVICE FOR EXTRACTING LIQUID FROM A WIPING COVERING

(75) Inventor: Yunus Demirtas, Kornwestheim (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 11/372,471

(22) Filed: Mar. 8, 2006

(65) Prior Publication Data

US 2006/0196001 A1 Sep. 7, 2006

Related U.S. Application Data

(63) Continuation of application No. PCT/EP2004/009150, filed on Aug. 14, 2004.

(30) Foreign Application Priority Data

Sep. 11, 2003 (DE) ..... 103 43 324

(51) Int. Cl.
*A47L 13/14* (2006.01)

(52) U.S. Cl. ..... 15/260; 15/263

(58) Field of Classification Search ..... None
See application file for complete search history.

(56) References Cited

U.S. PATENT DOCUMENTS 4,344,201 A * 8/1982 Trisolini ..... 15/3
2003/0167589 A1 9/2003 Dingert et al.
2005/0016570 A1* 1/2005 Xu et al. ..... 134/140

FOREIGN PATENT DOCUMENTS

| | | |
|---|---|---|
| DE | 102 23 074 | 8/2003 |
| FR | 2 672 791 | 8/1992 |
| WO | 02/89651 | 11/2002 |

OTHER PUBLICATIONS

*Patent Abstracts of Japan*, vol. 0152, No. 02, May 23, 1991, Abstract of JP 3 055022, "Cleaning Equipment", Mar. 8, 1991.

* cited by examiner

*Primary Examiner*—David Redding
(74) *Attorney, Agent, or Firm*—Lipsitz & McAllister, LLC

(57) ABSTRACT

The invention relates to a device for extracting liquid from a wiping covering of a surface wiping device which has a wiping head held on a handle and having two supporting arms, on which the wiping covering is held and which can be pivoted back and forth between a position aligned at right angles to the handle and a position aligned at an angle or parallel to the handle, wherein the device comprises a container, in which a rotatably drivable wiping head holder is arranged, the holder having a receiving area, into which the wiping head can be inserted with the wiping covering. In order to improve the device in such a manner that it has a compact type of construction and the wiping covering can have moisture removed from it with a low consumption of energy, it is suggested in accordance with the invention that the receiving area accommodate the wiping head with supporting arms pivoted forwards in the direction pointing away from the handle, wherein it has stops, on which the supporting arms can abut in the area of their upper side facing away from the wiping covering.

19 Claims, 4 Drawing Sheets

DEVICE FOR EXTRACTING LIQUID FROM A WIPING COVERING

This application is a continuation of International application No. PCT/EP2004/009150 filed on Aug. 14, 2004.

The present disclosure relates to the subject matter disclosed in International application No. PCT/EP2004/009150 of Aug. 14, 2004 and German application No. 103 43 324.4 of Sep. 11, 2003, which are incorporated herein by reference in their entirety and for all purposes.

BACKGROUND OF THE INVENTION

The invention relates to a device for extracting liquid from a wiping covering of a surface wiping device, wherein the surface wiping device comprises a wiping head held on a handle and having two supporting arms, on which the wiping covering is held and which are pivotable back and forth between an operative position, in which they are aligned at right angles to the handle, and a folded position, in which they are aligned parallel or at an angle to the handle, wherein the device comprises a container, in which a wiping head holder is held, this holder being drivable for rotation about an axis of rotation and having a receiving area, into which the wiping head with the wiping covering can be inserted.

An extraction device of this type is known from DE 102 23 074 C1. A wiping covering held on the wiping head of a surface wiping device can be wrung out with the aid of this device. This offers the possibility of cleaning a soiled surface, in particular, a floor surface with the aid of the surface wiping device in that the wiping head with the wiping covering is moved along the surface to be cleaned and dirt is thereby taken up. The wiping covering can then be rinsed and have moisture removed from it by means of the device without the user coming into contact with the cleaning liquid used.

The object of the present invention is to improve a device of the type specified at the outset in such a manner that it has a compact type of construction and the wiping covering can have moisture removed from it with a low consumption of energy.

SUMMARY OF THE INVENTION

This object is accomplished in accordance with the invention, in a device of the generic type, in that the receiving area accommodates the wiping head with supporting arms pivoted forwards in the direction pointing away from the handle, wherein the receiving area has stops, on which the supporting arms can abut in the area of their upper side facing away from the wiping covering.

The device according to the invention is used for a surface wiping device, the wiping head of which has two supporting arms which are pivotally mounted. The supporting arms take up an operative position for the cleaning of a surface, in which they are aligned at right angles to the handle of the surface wiping device. In this alignment, the wiping covering is tensioned flat on the underside of the supporting arms and can, therefore, be guided a really along the surface to be cleaned. Subsequently, the wiping covering can be rinsed and then have moisture removed from it. In order to remove moisture from the wiping covering, the two supporting arms can be pivoted forwards in the direction pointing away from the handle so that they take up a folded position, in which the wiping head has a relatively slight radial extension. In this position, the wiping head can be inserted into the receiving area of the extraction device according to the invention. This has the advantage that the receiving area must also have only a relatively slight extension in order to accommodate the wiping head and the wiping covering held on it.

In order to remove moisture from the wiping covering, the wiping head holder with a wiping covering positioned in it can be caused to rotate about the axis of rotation of the wiping head holder and on account of the centrifugal force acting on the wiping covering drops of liquid are expelled from the wiping covering so that this has moisture removed from it. In order to counteract any possible imbalance of the rotating wiping head, stops are arranged in the receiving area in accordance with the invention and the supporting arms can abut on these stops in the area of their upper side facing away from the wiping covering. It is ensured by means of the stops that the supporting arms retain their folded position despite the centrifugal force acting on them, wherein the supporting arms have an alignment which is beneficial for the removal of moisture from the wiping covering held on the supporting arms. It has, surprisingly, been shown that with supporting arms folded forwards the wiping covering held thereon can have moisture removed from it reliably with a relatively low use of energy.

In order to simplify the handling of the device according to the invention and to avoid the risk of an imbalance of the rotating wiping head, in addition, it is provided in a preferred embodiment for the wiping head holder to have a support member adjacent to the receiving area, on which a central bearing element of the wiping head can be supported, wherein the two supporting arms are held on the bearing element so as to be pivotable. The user can, therefore, insert the wiping head with the wiping covering into the receiving area for the purpose of having moisture removed from the wiping covering, wherein the central bearing element of the wiping head comes to rest on the support member while the two supporting arms held on the bearing element so as to be pivotable are pivoted into their folded position and can be positioned in the receiving area where they can abut on corresponding stops with their upper sides facing away from the wiping covering.

The support member can, for example, be designed in the form of a support surface which is recessed in steps and is arranged on a cover of the device.

A particularly low degree of residual moisture in the wiping covering can be achieved due to the fact that the receiving area accommodates the wiping head with supporting arms aligned parallel to one another, wherein the receiving area forms a free space accommodating the wiping covering below the supporting arms. With a configuration of this type, the two supporting arms can be pivoted forwards to such an extent in the direction pointing away from the handle that they are aligned essentially parallel to one another, wherein the wiping covering is held at the free ends of the supporting arms and is positioned in front of them. The wiping covering can be introduced into the free space of the receiving area and positioned in it. Subsequently, the wiping head holder can be caused to rotate in order to remove moisture from the wiping covering.

It is favorable when the receiving area widens transversely to the direction of insertion of the wiping head. This has the advantage that the wiping covering can be tensioned at least in sections within the free space during rotation of the wiping head holder on account of the centrifugal force acting on it while the two supporting arms are held reliably in their folded position by means of the associated stops since the receiving area has a smaller diameter in its upper end area transverse to the direction of insertion of the wiping head than in its lower end area, in which it forms the free space.

It has proven to be advantageous when the free space has a base wall with a central elevation. In particular, it may be provided for the base wall to be curved convexly inwards in a central area in relation to the axis of rotation of the wiping head holder. It may be ensured in a constructionally simple manner by means of the central elevation of the base wall that the wiping covering, which impinges on-the base wall of the free space during the insertion of the wiping head into the receiving area, impinges first of all on the central elevation and during further insertion of the wiping head abuts areally on the base wall.

Alternatively to the parallel alignment of the two supporting arms, it may be provided for the receiving area to accommodate the wiping head with supporting arms aligned at an angle to the handle, wherein the wiping head holder has a retaining element holding the wiping covering between the two supporting arms. In contrast to the embodiment explained in the above, the wiping covering in a configuration of this type takes up a position between the two supporting arms aligned at an angle to the longitudinal axis of the handle. A retaining element is used for this purpose. It has been shown that with such an alignment of the wiping covering within the receiving area a particular good removal of moisture from the wiping covering can be achieved without a high expenditure of energy being required for this purpose.

The retaining element may be designed, for example, in the form of a base wall of the receiving area, on which the wiping covering can abut areally. For this purpose, it is favorable when the base wall is of a wavy design.

In a particularly preferred embodiment, the retaining element is designed as a crossbar which passes through the receiving area. The crossbar may, in this respect, be designed at a distance to the base wall of the receiving area. This has the advantage that the wiping covering can be held in the receiving area without contact in the area between the crossbar and the free ends of the supporting arms. It has been shown that with such an alignment of the wiping covering drops of liquid can be expelled from the wiping covering particularly effectively and so a reliable removal of moisture can be achieved with a relatively low expenditure of energy.

It is of particular advantage when the crossbar is aligned at right angles to the axis of rotation of the wiping head holder. As a result, the insertion of the wiping head with the wiping covering into the receiving area can be simplified since the supporting arms are pressed apart in the direction of their respective stops when the free ends of the supporting arms impinge on the crossbar and the wiping covering abuts on the crossbar with its central area.

The insertion of the wiping head with wiping covering held thereon can be simplified, in addition, in that the crossbar is held in the receiving area so as to be rotatable about its longitudinal axis since, as a result, the wiping covering can roll along the crossbar if an off-center area of the wiping covering comes to rest on the crossbar first of all.

The crossbar is preferably profiled so that the wiping covering abuts on the crossbar essentially only in a punctiform or linear manner. It may, for example, be provided for the crossbar to be designed as a roller which is held in the receiving area so as to be rotatable and has longitudinal grooves.

As already explained, it is provided in accordance with the invention for the supporting arms to each abut on at least one stop in the area of their upper side facing away from the wiping covering so that the supporting arms are held in the receiving area so as to be essentially non-pivotable. In this respect, it is favorable when the wiping head holder has two supports which each form a stop for a supporting arm. The supports are preferably movable contrary to the action of an elastic restoring force during the insertion of the wiping head into the receiving area since, as a result, the supports can exert a spring force, which is directed radially inwards in relation to the axis of rotation of the wiping head holder, on the respectively associated supporting arm.

In one preferred embodiment, the supports are each mounted so as to be pivotable about a pivot axis aligned at right angles to the axis of rotation. As a result, they may be pivoted about their respective pivot axis between a position located radially inwards in relation to the axis of rotation of the wiping head holder and a position located radially outwards.

In order to secure the supporting arms within the receiving area, it is favorable when the container has two pocket-like recesses, into each of which a free end area of a supporting arm can be inserted. The supporting arms can be secured within the container in a constructionally simple manner by means of the pocket-like recesses and so they maintain their alignment during the rotational movement of the wiping head holder practically unaltered and, consequently, imbalances are reliably avoided.

In order to simplify the handling of the device according to the invention, it is provided in one preferred embodiment for the wiping head holder to comprise an entry section with two guide members aligned in a V shape relative to one another, wherein the wiping head can be inserted into the receiving area through the entry section. The insertion of the wiping head with wiping covering held thereon into the wiping head holder is simplified as a result of the guide members aligned in a V shape relative to one another.

It is of advantage when the guide members can be moved in the direction pointing away from one another in a spring elastic manner since, as a result, the entry section can be spread during the insertion of the wiping head and so the insertion of the wiping head experiences an additional simplification.

In one preferred configuration, the guide members each form a slide plate which is held so as to be pivotable and along which the wiping head with the wiping covering can slide into the receiving area.

At their respective free end, the slide plates preferably bear a support for abutment on a supporting arm since, as a result, the constructional configuration of the device according to the invention can be simplified, wherein it is ensured that the wiping head with the wiping covering can be introduced into the receiving area in a simple manner and the supporting arms can be secured in the receiving area in order to avoid imbalances during the rotation of the wiping head.

In this respect, it is of particular advantage when the slide plate and the associated support are connected to one another in one piece. It may, for example, be provided for the slide plate and the support to be produced from a dimensionally flexible material, preferably from a dimensionally flexible plastic material.

The following description of two advantageous embodiments serves to explain the invention in greater detail in conjunction with the drawings.

DETAILED DESCRIPTION OF THE INVENTION

Figure 1:
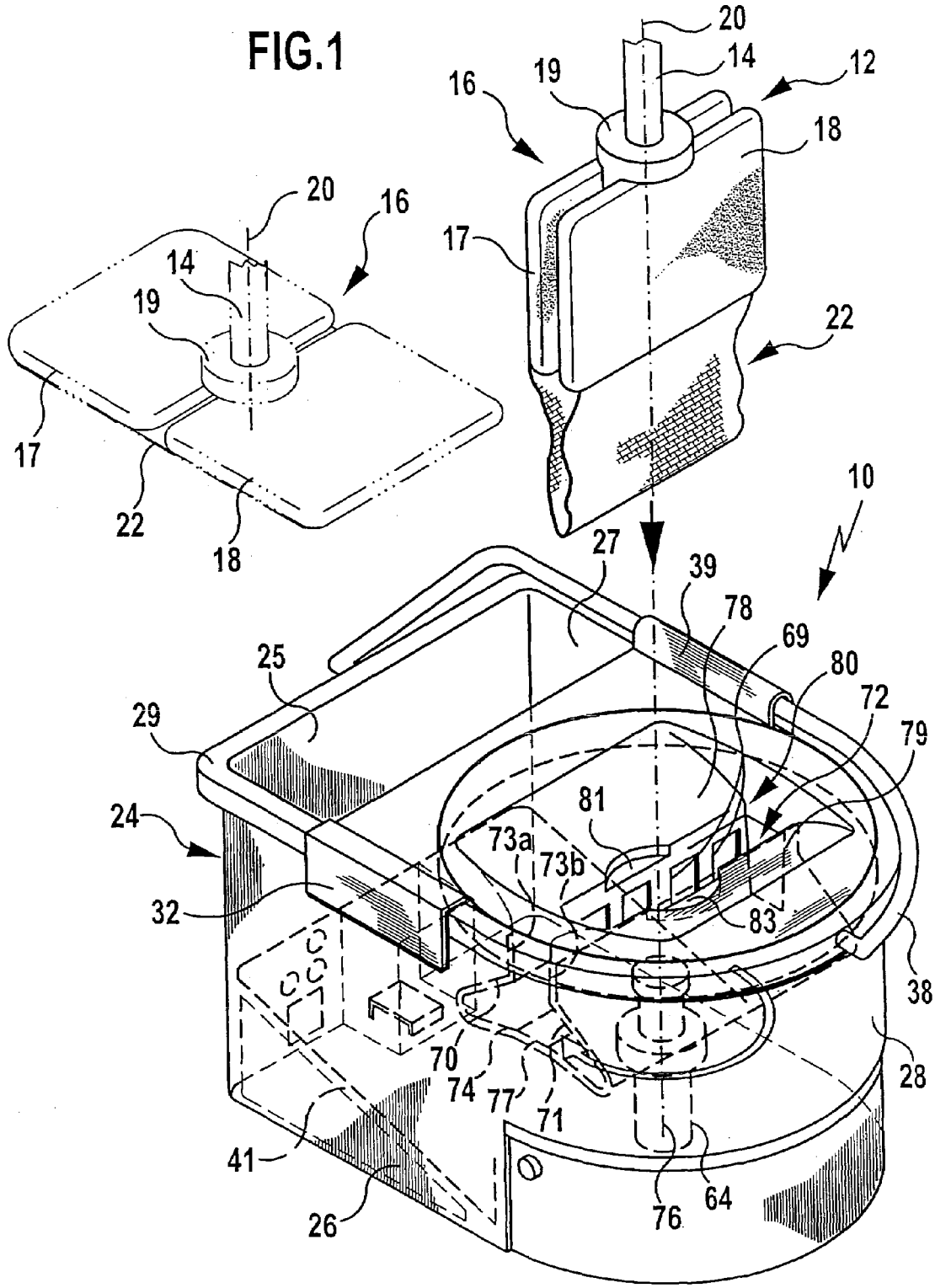
FIG. 1: shows a diagrammatic illustration of a first embodiment of a device according to the invention for rinsing and extracting liquid from a wiping covering held on a wiping head of a surface cleaning device.
Figure 2:
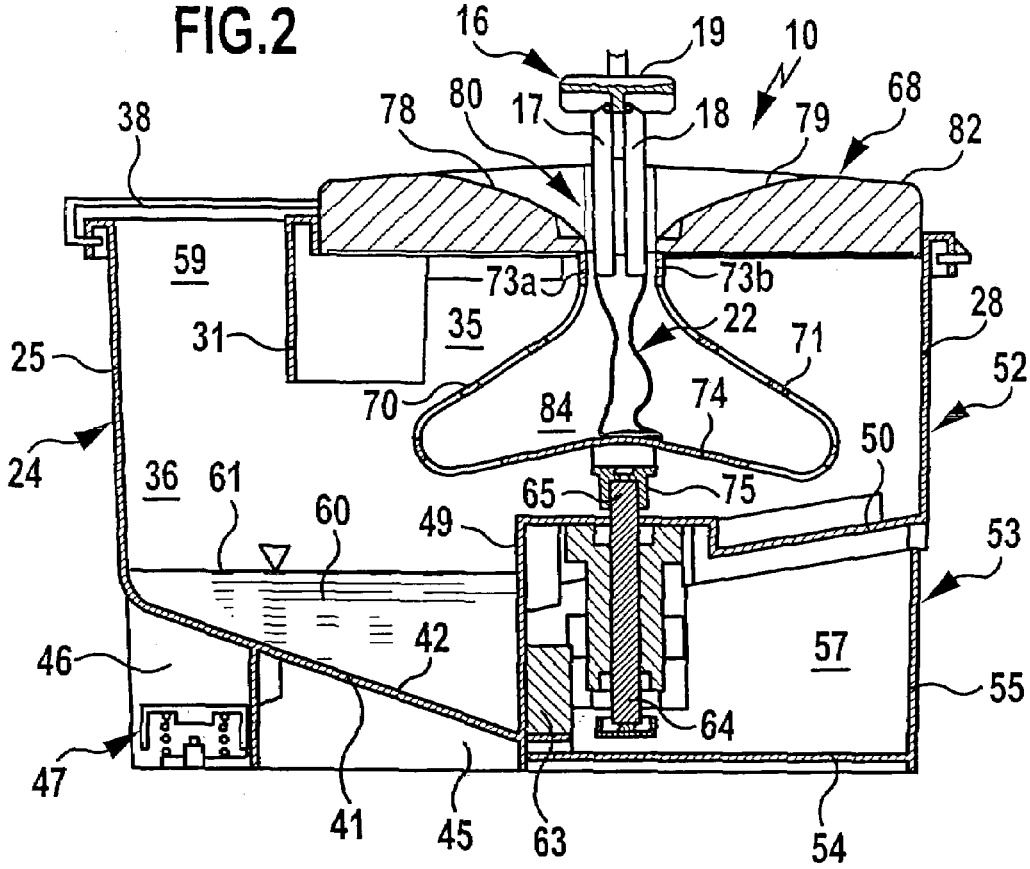
FIG. 2: shows a sectional view of the device along line 2-2 in FIG. 3.
Figure 3:
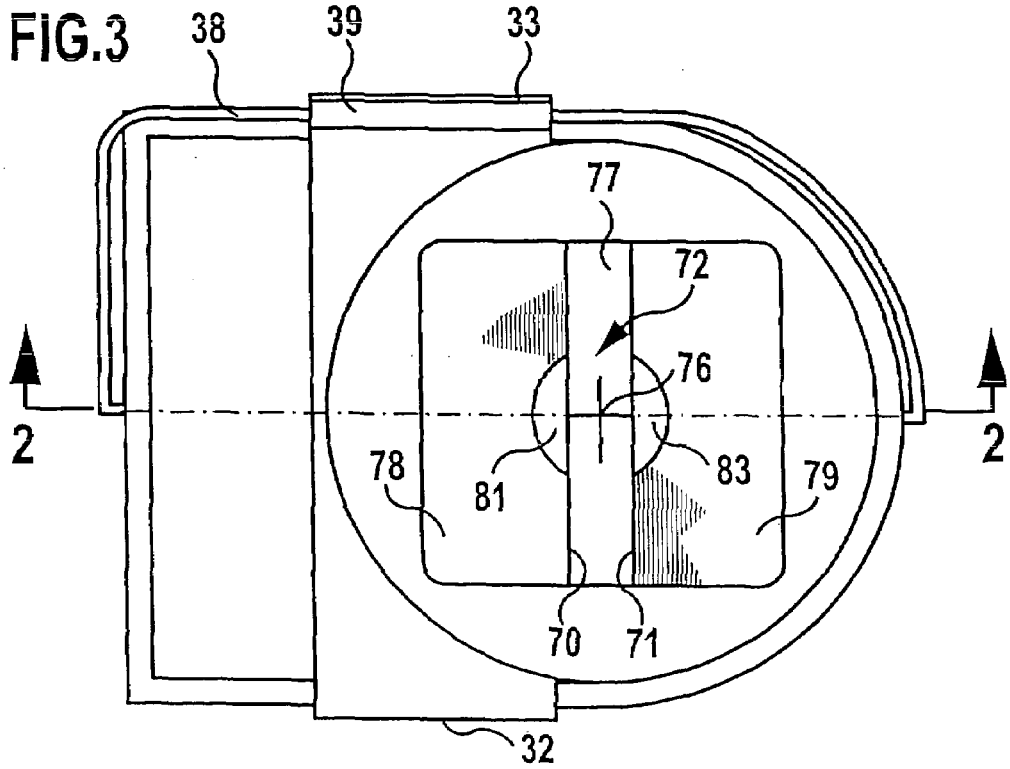
FIG. 3: shows a simplified plan view of the device according to FIG. 1.

A first embodiment of a device according to the invention for extracting liquid from a wiping covering of a surface cleaning device, designated with the reference numeral 10, is illustrated in FIGS. 1, 2 and 3. The surface cleaning device 12 comprises a handle 14 which bears a wiping head 16 at one end with two supporting arms 17, 18 which are held on a central wiping head bearing 19 in an articulated manner. The supporting arms 17, 18 may be pivoted back and forth between an operative position, which is illustrated by dash-dot lines in FIG. 1 and in which they are aligned at right angles to the longitudinal axis 20 of the handle 14, and a folded position, which is illustrated by solid lines in FIG. 1 and in which they are aligned forwards in the direction pointing away from the handle 14 and arranged parallel to one another. In their operative position, the two supporting arms 17, 18 can be fixed on the wiping head bearing 19 via securing means which are not illustrated in the drawings and can be operated by the user.

A wiping covering 22 in the form of a textile fabric, preferably a wiping mop, is held at the free ends of the two supporting arms 17, 18. The wiping covering 22 is tensioned flat by the two supporting arms 17 and 18 in their operative position so that it can abut areally on a surface to be cleaned, for example, a floor surface and can be moved along this surface.

If the two supporting arms 17, 18 take up their folded position pointing forwards, the wiping covering 22 is suspended from the free ends of the supporting arms 17, 18, as illustrated in FIG. 1 by solid lines.

Floor surfaces may be cleaned in the customary manner by means of the surface cleaning device 12. For this purpose, the wiping covering 22 is moistened and, subsequently, moved along the surface to be cleaned so that, for example, dust can be taken up from the floor surface. Subsequently, the wiping covering 22 is rinsed and moisture removed from it so that it then has only a slight degree of moistness.

The device 10 is used in accordance with the invention for the purpose of rinsing and removing moisture from the wiping covering 22. This device comprises a container in the form of a bucket 24 which has a flat transverse wall 25 which is connected in one piece to longitudinal walls 26, 27 which are aligned at right angles in relation to the transverse wall 25 and arranged parallel to one another. The longitudinal walls are connected to one another in one piece on their side facing away from the transverse wall 25 via a curved wall 28 designed in the shape of a semi-cylinder. On the upper side, the specified walls 25 to 28 define a circumferential upper edge 29 of the bucket 24.

A dividing wall 31 curved in the shape of a circular arc is inserted into the bucket 24; this dividing wall engages over the upper edge 29 in the area of the longitudinal walls 26, 27 approximately in the center with holding elements in the form of lateral holding flanges 32, 33 and divides the interior of the bucket 24 into a spinning area 35 and a washing area 36.

A carrying bracket 38 is articulated to the upper edge 29 in the area of the transverse wall 25 and the curved wall 28, each time in the center, and a carrying handle 39 is held on this bracket in the center. The carrying bracket 38 reaches over the washing area 36 and the spinning area 35 in longitudinal direction of the bucket 24 and can be pivoted between a position resting on the upper edge 29 and a position pivoted upwards.

The two longitudinal walls 26, 27 are connected to one another in one piece at a clear distance from the dividing wall 31 via a base wall 41 of the bucket 24 which is inclined at an angle to the vertical in the direction of the spinning area 35. The base wall 41 has an upper side 42 facing the interior space of the bucket 24.

The transverse wall 25 projects downwards below the base wall 41 in the same way as the two longitudinal walls 26, 27. In this projecting area, they define a free space 45 which is freely accessible from below. The transverse wall 25 has beneath the base wall 41 a recessed area 46 which dips into the free space 45 and in which a control element in the form of a foot switch 47 activatable by the user is arranged.

A step wall 49 aligned essentially parallel to the transverse wall 25 is integrally formed on the end of the base wall 41 facing away from the transverse wall 25; this step wall extends approximately as far as up to half the height of the bucket 24 and an intermediate wall 50, which is aligned essentially horizontally and via which the step wall 49 is connected to the curved wall 28, adjoins the step wall in one piece.

The transverse wall 25 forms in combination with the two longitudinal walls 26, 27 and the curved wall 28 as well as the base wall 41, the step wall 49 and the intermediate wall 50 a base member 52 which is designed in one piece, is designed as a plastic molded part and, as a result of the intermediate wall 50 and the step wall 49, forms a recessed area which is covered by a cover 53 which is formed in one piece, is releasably connected to the base member 52 and has a base plate 54 as well as a side wall 55 projecting upwards at right angles from the base plate 54 in the area of the curved wall 28.

A drive chamber 57 is defined by the cover 53 as well as the step wall 49 and the intermediate wall 50 beneath the washing area 36.

The washing area 36 forms an entry channel 59 at the level of the dividing wall 31 and a liquid collection area 60, which accommodates a cleaning liquid 61, preferably water, is formed in the area between the base wall 41 aligned at an angle and the step wall 49 aligned vertically. This is apparent from FIG. 2.

The drive chamber 57 accommodates an electric motor 63 which is coupled via gear elements which are known per se and not, therefore, illustrated in the drawings to a drive shaft 64 which is mounted for rotation, passes through the intermediate wall 50 with an upper end area 65 facing the spinning area 35 and dips into the spinning area 35.

The drive chamber 57 accommodates, in addition to the electric motor 63, a battery which is not shown in the drawings and can be recharged for supplying energy to the electric motor 63.

The electric motor 63 communicates via electric connection lines, which are known per se and not illustrated in the drawings, with an electric control unit which is arranged in the drive chamber 57 or alternatively in the free space 45 and, for its part, is connected to the foot switch 47. The electric motor 63 can be activated by actuating the foot switch 47 and, as a result, the drive shaft 64 is caused to rotate.

The spinning area 35 accommodates a wiping head holder 68 which is designed in one piece in the form of a plastic molded part and has two side walls 70, 71 which are curved in the direction pointing away from one another. The side walls 70, 71 have a plurality of openings 69 and define a cage-like receiving area 72 which is approximately T-shaped or bell-shaped in cross section and into which the wiping head 16 and the wiping covering 22 can be inserted, wherein the two supporting arms 17, 18 are folded forwards in the direction pointing away from the handle 14 and are aligned essentially parallel to one another. This is apparent, in particular, from FIG. 2. The side walls 70, 71 have a slighter distance from one another in their upper end area facing away from the drive shaft 64 than in their lower end area facing the drive shaft 64. In their upper end are*a,* they each form a stop 73*a,* 73*b,* on which the supporting arms 17 and 18, respectively, can abut with their upper side facing away from the wiping covering. The supporting arms 17, 18 cannot, therefore, be pivoted within the receiving area 72.

The two side walls 70, 71 are connected to one another in one piece via a connecting wall 74 which forms a base of the receiving area 72 and bears a bushing 75, in which the upper end area 65 of the drive shaft 64 engages, on its underside facing away from the receiving area 72, wherein the drive shaft 64 is connected non-rotatably to the bushing 75. The connecting wall 74 is curved convexly inwards and therefore has an elevation 77 in its central area.

On the upper side, a slide plate 78 and 79, respectively, which is aligned at an angle in relation to the axis of rotation 76 of the drive shaft 64, adjoins each of the side walls 70, 71. The slide plates 78, 79 are essentially aligned in a V shape in relation to one another and form an entry aid for the wiping head 16 with the wiping covering 22 held thereon. The two slide plates 78, 79 define between them an entry section 80 of the wiping head holder 68. The two slide plates 78, 79 are surrounded in circumferential direction by a lid 82 which is curved convexly upwards and covers the spinning area 35 of the bucket 24 with the exception of the receiving area 72.

A step 81 and 83, respectively, is integrally formed in each of the slide surfaces 78, 79 in the center. The steps 81, 83 form a support member, onto which the wiping head bearing 19 can be placed.

As already explained, the wiping head 16 can be inserted into the receiving area 72, wherein the wiping head bearing 19 is seated on the steps 81, 83 and the two supporting arms 17, 18 are folded forwards and bear the wiping covering 22 at their ends. During insertion into the receiving area 72, the wiping covering 22 hangs forwards beyond the free ends of the supporting arms 17, 18. As a result, the wiping covering 22 can be introduced into a free space 84 of the receiving area 72 which is defined laterally by the end areas of the two side walls 70 and 71 adjacent to the connecting wall 73. If head holder 68 is caused to rotate, the wiping covering 22 can be tensioned within the free space 84 under the influence of the centrifugal force.

Before the wiping head 16 is introduced into the receiving area 72, the wiping covering 22 can first of all dip into the liquid collection area 60 of the bucket 24 via the entry channel 59 and be rinsed by means of the cleaning liquid 61 located therein. For this purpose, the wiping covering 22 can be moved along the upper side 42 of the base wall 41. The base wall 41 forms a washing or friction plate, with the aid of which the wiping covering 22 can be thoroughly washed.

After successful rinsing, the user can then insert the wiping head 16 into the receiving area 72, as explained above, and cause the wiping head holder 68 to rotate so that the liquid is expelled out of the wiping covering 22 and this is left with only a slight degree of moisture and can then be moved again along the surface to be cleaned.

Figure 4:
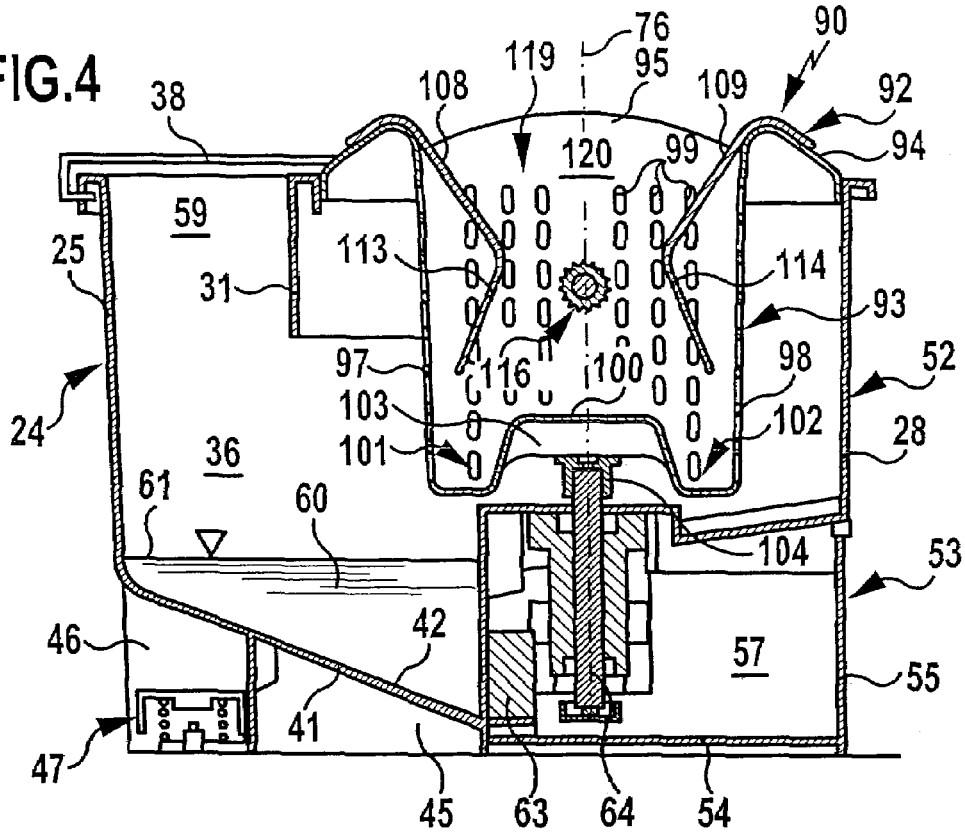
FIG. 4: shows a sectional view of a second embodiment of a device according to the invention for rinsing and extracting liquid from a wiping covering held on a wiping head of a surface cleaning device along line 4-4 in FIG. 5.
Figure 5:
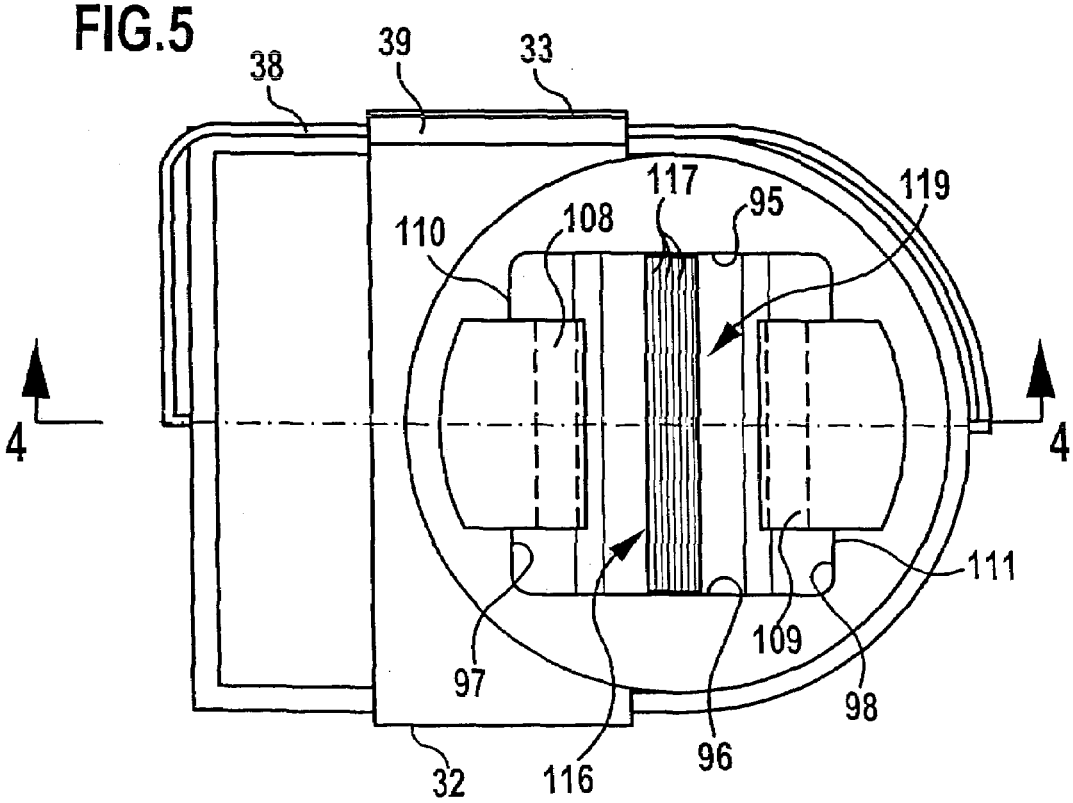
FIG. 5: shows a simplified plan view of the device according to FIG. 4.
Figure 6:
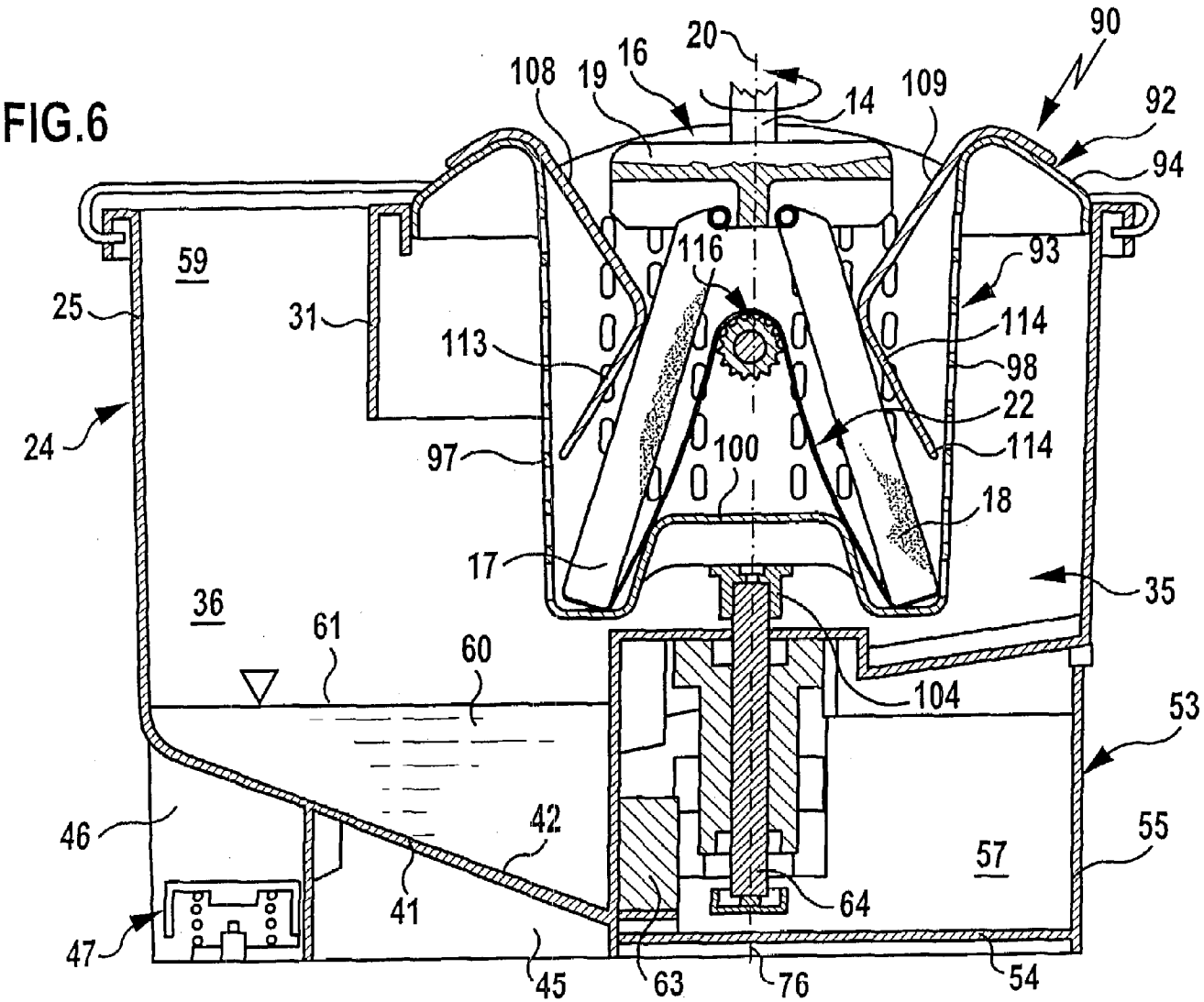
FIG. 6: shows a sectional view corresponding to FIG. 4 with a wiping head inserted into a receiving area of the device.

A second embodiment of a device designated altogether with the reference numeral 90 is illustrated in FIGS. 4, 5 and 6. This is to a great extent of an identical design to the device 10 explained above with reference to FIGS. 1 to 3. Therefore, the same reference numerals as those used in FIGS. 1 to 3 will be used for identical components. In this respect, reference is made to the preceding explanations to avoid repetitions.

Instead of the wiping head holder 68 explained above, a wiping head holder 92 is used for the device 90 and this comprises an insert 93 which dips into the spinning area 35 and is designed in one piece as a plastic molded part. The insert 93 has on the upper side a lid 94 which is curved convexly outwards and which is adjoined in one piece by two insert longitudinal walls 95, 96 arranged parallel and at a distance to one another as well as two insert transverse walls 97, 98 aligned at right angles to the insert longitudinal walls 95, 96 which each have a plurality of openings 99. The insert 93 is therefore of a cage-like design. The insert longitudinal and transverse walls 95 to 98 are connected to one another in one piece via an insert base wall 100 which defines a pocket-like recess 101 and 102, respectively, adjacent to the lower end areas of each of the insert transverse walls 97 and 98. On the underside, a support rib 103, which connects the pocket-like recesses 101 and 102 to one another and on which a connector bushing 104 connected non-rotatably to the drive shaft 64 is held, is integrally formed on the insert base wall 100. The insert 93 may be inserted into the spinning area 35 of the bucket 24, wherein a non-rotatable connection to the drive shaft 64 can be provided via the connector bushing 104. The insert 93 can be caused to rotate about the axis of rotation 76 by means of the drive shaft 64 driven by the electric motor 63.

A slide plate 108 and 109, respectively, which is directed at an angle to the axis of rotation 76 of the drive shaft 64 in the interior of the insert 93, is secured to each of the two insert transverse walls 97 and 98 at the level of the lid 94. These slide plates are produced from a dimensionally flexible material, preferably from a plastic material, and may be pivoted contrary to an elastic restoring force about the respective upper edge 110 and 111 of the insert transverse walls 97, 98 in the direction of the respective insert transverse wall 97 or 98. The upper edges 110 and 111 consequently define a respective pivot axis for the slide plates 108, 109.

A support 113 and 114, respectively, is integrally formed at the free ends of each of the slide plates 108 and 109. The supports 113 and 114 are likewise aligned at an angle to the axis of rotation 106, wherein they come close to the respective insert transverse walls 97 and 98 with their free end areas without, however, touching them. The support walls 113, 114 can, like the slide plates 108 and 109, be pivoted about the upper edges 110 and 111, respectively, in the direction of the insert transverse walls 97 and 98, respectively, proceeding from their rest position illustrated in FIG. 3.

At the level of the area of transition between the slide plates 108 and 109 and the respective supports 113 and 114, the insert 93 has a rotatable roller 116 passing through it which is aligned at right angles to the axis of rotation 106 and is mounted on the insert longitudinal walls 95, 96 at its ends so as to be freely rotatable and which has a groove-like profile which is formed by a plurality of longitudinal grooves 117.

The insert longitudinal and transverse walls 95, 96, 97, 98 as well as the insert base wall 100 limit a receiving area 119, into which the wiping head 116 can be inserted with the wiping covering 22 held thereon. This is particularly apparent from FIG. 6. The two supporting arms 17, 18 of the wiping head 16 can, in this respect, take up a folded position first of all, in which they are aligned essentially parallel to one another, as illustrated in FIG. 1. The wiping covering 22 which projects forwards first of all can then be inserted, like the free ends of the supporting arms 17, 18, into an entry section 120 which is arranged between the two slide plates 108, 109. The free ends of the two supporting arms 17 and 18, like the wiping covering 22, subsequently impact on the rotatable roller 116. As a consequence, the wiping covering is held back during the further insertion of the wiping head 16 into the receiving area 119 while the two supporting arms 17, 18 take up a position aligned at an angle to the longitudinal axis 20 of the handle 14, the two slide plates 108 and 109 and the supports 113, 114 held thereon hereby pivot outwards in the direction of the insert transverse walls 97 and 98, respectively, and, finally, dip with their respective end areas into one of the pocket-like recesses 101 and 102, respectively. This is illustrated in FIG. 6. In this respect, a spring force directed radially inwards in relation to the axis of rotation 76 of the drive shaft 64 is exerted on the supporting arms 17, 18 by the supports 113, 114 pivoted in the direction of the insert transverse walls 97 and 98, respectively. Consequently, the supports 113 and 114 each form a flexible stop, on which the supporting arms 17 and 18, respectively, abut in the area of their upper side facing away from the wiping covering 22. The wiping covering therefore takes up a position between the two supporting arms 17, 18 aligned at an angle to the longitudinal axis 20 of the handle 14 when the wiping head 16 is inserted into the receiving area 119, wherein it touches the two supporting arms 17, 18 at their free end areas and the rotatable roller 116 along a section of its outer circumference while the remaining areas of the wiping covering 22 experience no contact.

If the insert 93 is subsequently caused to rotate due to actuation of the foot switch 47, moisture can be effectively removed from the wiping covering 22 on account of the centrifugal force acting on the wiping covering 22. Beforehand, the wiping covering 22 can, as explained above with reference to FIGS. 1, 2 and 3, be rinsed thoroughly in the washing area 36.

The invention claimed is:

1. In combination, a surface wiping device and a device for extracting liquid from a wiping covering of the surface wiping device:

the surface wiping device comprising:

a handle, a wiping head held on the handle, and two supporting arms, the wiping covering being held on said arms and said arms being pivotable back and forth between an operative position, said arms being aligned at right angles to the handle in said operative position, and a folded position, said arms being aligned parallel or at an angle to the handle in said folded position, and the device for extracting liquid comprising:

a container, and a wiping head holder drivable for rotation about an axis of rotation being arranged in said container and having a receiving area limited by longitudinal and transverse side walls and a base wall, the wiping head with the wiping covering being insertable into said receiving area, wherein the receiving area accommodates the wiping head with supporting arms pivoted forwards in a direction pointing away from the handle, wherein the receiving area has stops, the supporting arms being adapted to abut on said stops in an area of an upper side of said supporting arms facing away from the wiping covering.

2. A combination as defined in claim 1, wherein the wiping head holder has a support member adjacent to the receiving area, a central bearing element of the wiping head being supported on said support member, wherein the two supporting arms are held on the bearing element so as to be pivotable.

3. A combination as defined in claim 1, wherein the receiving area accommodates the wiping head with supporting arms aligned parallel to one another, wherein the receiving area forms a free space accommodating the wiping covering below the supporting arms.

4. A combination as defined in claim 3, wherein the receiving area widens transversely to a direction of insertion of the wiping head.

5. A combination as defined in claim 3, wherein the free space has a base wall with a central elevation.

6. A combination as defined in claim 1, wherein the receiving area accommodates the wiping head with supporting arms aligned at an angle to the handle, wherein the wiping head holder has a retaining element holding the wiping covering between the two supporting arms.

7. A combination as defined in claim 6, wherein the retaining element is designed as a crossbar passing through the receiving area.

8. A Device for extracting liquid from a wiping covering of a surface wiping device, wherein the surface wiping device comprises a wiping head held on a handle and having two supporting arms, the wiping covering being held on said arms and said arms being pivotable back and forth between an operative position, said arms being aligned at right angles to the handle in said operative position, and a folded position, said arms being aligned parallel or at an angle to the handle in said folded position, the device comprising:

a container, a wiping head holder drivable for rotation about an axis of rotation being arranged in said container and having a receiving area, the wiping head with the wiping covering being insertable into said receiving area, wherein:

the receiving area accommodates the wiping head with supporting arms pivoted forwards in a direction pointing away from the handle, the receiving area has stops, the supporting arms being adapted to abut on said stops in an area of an upper side of said supporting arms facing away from the wiping covering, the receiving area accommodates the wiping head with supporting arms aligned at an angle to the handle, the wiping head holder has a retaining element holding the wiping covering between the two supporting arms, the retaining element is designed as a crossbar passing through the receiving area, and the crossbar is aligned at right angles to the axis of rotation of the wiping head holder.

9. A combination as defined in claim 7, wherein the crossbar is held in the receiving area so as to be rotatable about its longitudinal axis.

10. A combination as defined in claim 6, wherein the retaining element comprises a roller.

11. A Device for extracting liquid from a wiping covering of a surface wiping device, wherein the surface wiping device comprises a wiping head held on a handle and having two supporting arms, the wiping covering being held on said arms and said arms being pivotable back and forth between an operative position, said arms being aligned at right angles to the handle in said operative position, and a folded position, said arms being aligned parallel or at an angle to the handle in said folded position, the device comprising:

a container, and a wiping head holder drivable for rotation about an axis of rotation being arranged in said container and having a receiving area, the wiping head with the wiping covering being insertable into said receiving area, wherein:

the receiving area accommodates the wiping head with supporting arms pivoted forwards in a direction pointing away from the handle, and the wiping head holder has two supports each forming a stop for one of the supporting arms.

12. Device as defined in claim 11, wherein the supports are movable contrary to the action of an elastic restoring force during the insertion of the wiping head into the receiving area.

13. Device as defined in claim 11, wherein the supports are each mounted so as to be pivotable about a pivot axis aligned at right angles to the axis of rotation of the wiping head holder.

14. A combination as defined in claim 1, wherein the wiping head holder has two pocket-like recesses, a free end area of a supporting arm being insertable into each of said recesses.

15. A combination as defined in claim 1, wherein the wiping head holder comprises an entry section with two guide members aligned in a V shape relative to one another, wherein the wiping head is insertable into the receiving area through the entry section.

16. A combination as defined in claim 15, wherein the guide members are movable in a direction pointing away from one another in a spring elastic manner.

17. A combination as defined in claim 15, wherein the guide members each form a pivotable slide plate.

18. A combination as defined in claim 17, wherein at their free end the slide plates each bear a corresponding support for abutment on a supporting arm.

19. A combination as defined in claim 18, wherein each slide plate is connected in one piece to the corresponding support.

* * * * *